US005683016A

United States Patent [19]

Santagiuliana

[11] Patent Number: 5,683,016

[45] Date of Patent: Nov. 4, 1997

[54] MOLDED PLASTIC CAP FOR DISPENSING LIQUIDS

[75] Inventor: Evans Santagiuliana, Vicenza, Italy

[73] Assignee: Taplast Srl, Povolaro Dueville, Italy

[21] Appl. No.: 362,428

[22] PCT Filed: May 5, 1994

[86] PCT No.: PCT/EP94/01427

§ 371 Date: Dec. 28, 1994

§ 102(e) Date: Dec. 28, 1994

[87] PCT Pub. No.: WO94/26611

PCT Pub. Date: Nov. 24, 1994

[30] Foreign Application Priority Data

May 6, 1993 [IT] Italy ..... VI93A0071

[51] Int. Cl.[6] ..... B67B 5/00

[52] U.S. Cl. ..... 222/153.14; 222/556; 222/562; 215/237

[58] Field of Search ..... 222/211, 212, 222/213, 556, 562, 568, 153.14; 215/235, 237

[56] References Cited

U.S. PATENT DOCUMENTS

| | | | |
|---|---|---|---|
| 2,571,504 | 10/1951 | Vuillemenot | 222/211 |
| 3,381,860 | 5/1968 | Armour | 222/211 |
| 3,710,989 | 1/1973 | Armour | 222/211 |
| 4,782,964 | 11/1988 | Poore et al. | 215/237 |
| 4,809,874 | 3/1989 | Pehr | 215/235 |
| 4,838,441 | 6/1989 | Chernack | 215/235 |
| 4,940,167 | 7/1990 | Fillmore et al. | 215/237 |

FOREIGN PATENT DOCUMENTS

| | | | |
|---|---|---|---|
| 2 113 896 | 6/1972 | France . | |
| 2 279 634 | 3/1976 | France . | |
| 2 380 195 | 10/1978 | France . | |
| 2 591 571 | 6/1987 | France . | |
| 2076378 | 12/1981 | United Kingdom | 222/556 |

*Primary Examiner*—Philippe Derakshani
*Attorney, Agent, or Firm*—Watson Cole Stevens Davis

[57] ABSTRACT

A plastic cap for dispensing liquids to be connected to the neck of a deformable container, includes a main body having a first outer wall that can be assembled to the neck of the container and an inner coaxial wall that can be introduced inside the container to seal the neck. The main body has a generally cylindrical central part with a non-axial outlet for the liquid, and with fins for fastening a liquid suction pipe. The body has a hook near the outer edge for cooperating with a corresponding hook on the cover connected with the main body by means of a hinge. The cover has a central hollow cylindrical element for engaging and sealing the central part. The main body is formed with an opening under the hook to facilitate molding.

7 Claims, 2 Drawing Sheets

MOLDED PLASTIC CAP FOR DISPENSING LIQUIDS

BACKGROUND OF THE INVENTION

1. Field of the Invention

The invention is a plastic cap particularly suitable for dispensing liquids, which can be connected to the neck of a deformable container. We are referring in particular to plastic caps in which an outflow duct is connected with a pipe for drawing the liquid from the bottom of the container.

2. General State of the Art

The known types of plastic caps for dispensing liquids substantially have a body connected with the neck of the container, said body being provided with a central part that projects outwards and is connected to a pipe drawing out the liquid. These caps are also provided with a cover connected with the central body of the cap by means of a hook and they can be separated from said central body by deforming the container with the pressure of the fingers.

According to the known technique, this sort of caps is carried out by means of a complex mould, in order to obtain the tooth that belongs to the body of the cap and sticks out of the base of said body upwards, in such a way as to cooperate with a corresponding hook situated on the cover. Both the patents DE 3632057-C2 and the patent FR 2 591 571 concern a plastic cap for dispensing liquids in which the cover closes against that part of the cap that is fixed to the bottle by means of a hook belonging to said part.

The drawing regarding the practical application of the patent clearly shows that the hook is obtained by means of a mould with at least a carriage moving transversally with respect to the opening and closing direction of the mould.

SUMMARY OF THE PRESENT INVENTION

A purpose of the invention is to obtain a cap structured so that it can be carried out by means of a very simple mould without transversal carriages.

Another purpose to be reached is that the cap of the invention has a sealing capacity at least equivalent to that of the caps of the same kind known up to now.

All the purposes mentioned above and others that will be better highlighted below, have been achieved by a plastic cap for dispensing liquids to be connected to the neck of a deformable container, which according to the first claim comprises:

a main body having a first substantially cylindrical outer wall that can be screwed onto the neck of the container and is coaxial with respect to a second cylindrical wall introduced into the neck of the container, said main body having, in the middle, a generally cylindrical hollow part projecting upwards and provided with fins for fastening a suction pipe suitable for drawing the liquid out of the container, the cylindrical hollow part having a lateral outlet for flowing the liquid, said main body being provided in the front of the cap with a hook placed approximately near the perimetrical edge of said body and suitable for cooperating with the corresponding projection positioned on a cover;

a cover connected by means of an elastic hinge to said main body, said cover being provided in the middle with a hollow cylindrical element housing the cylindrical part of said main body and having, in correspondence with its inner edge, a hook-shaped projection suitable for cooperating with the corresponding projection of the main body, the invention being characterized in that, at the base of the hook of said main body, there is a hole through which a mold part (not shown) passes during the moulding, said part moving in accordance with the axis of said main body.

Advantageously, according to the invention, due to the presence of a hole in the cap there is the possibility of moulding the cap by means of a substantially very simple mould without carriages, since, as it will be observed later on, the moulding takes place by direct clamping with a single movement of the mould along its only clamping axis.

Even with a hole at the end of the edge of the cap the outflow of the liquid is prevented since the cap seal with respect to the neck of the container is guaranteed both by the cylindrical wall resting on the inner edge of the neck and by a ring-projection resting on the plane of the upper edge of the container neck. In such a way at least two seals are obtained, besides the outer one due to the screwing of the cap onto the neck, and therefore the presence of the hole on the cap don't compromise the expected sealing effect.

BRIEF DESCRIPTION OF THE DRAWINGS

Further distinctive features and peculiarities will be better highlighted in the description of a practical application among many of the invention in question, illustrated in the attached tables.

DESCRIPTION OF THE PREFERRED EMBODIMENT

Figure 2:
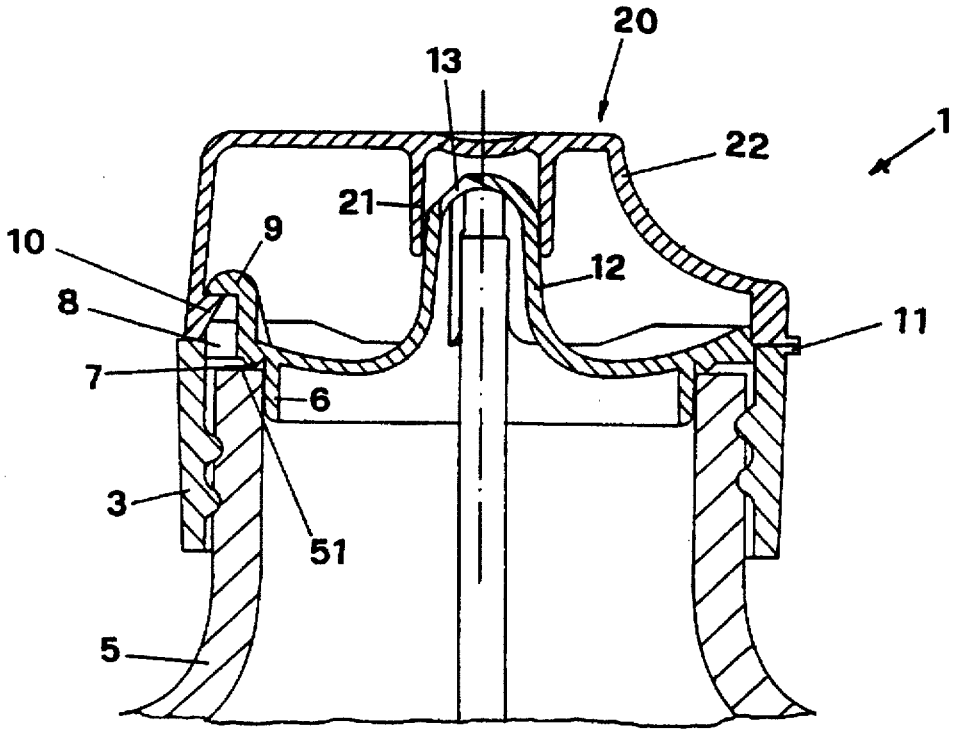
FIG. 2 shows a section of the cap object of the invention when closed.
Figure 1:
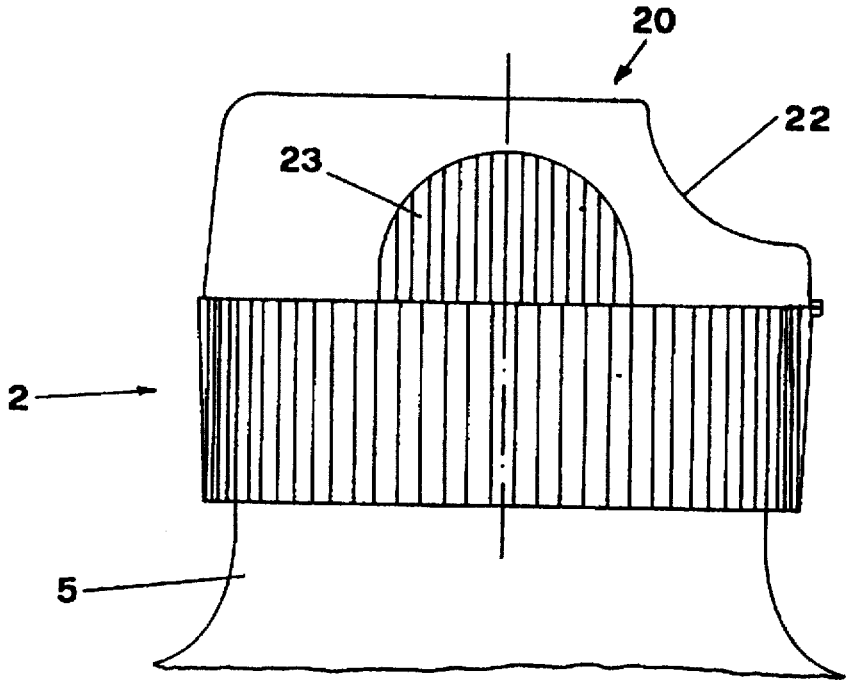
FIG. 1 shows a view of the cap that is the object of the invention.

With reference to the above-mentioned figures it can be noticed that the cap object of the invention, referred to as a whole by 1, has a main body, referred to as a whole by 2, which has a first substantially cylindrical outer wall 3 and is provided inside with a thread 4 allowing the cap to be screwed onto the neck 5 of the deformable container. The diameter of a second wall, referred to by 6, which is cylindrical, too, and is substantially coaxial with respect to the first outer wall 3, is such as to make it possible to introduce its outer wall into the inner edge of the neck 5, so as to obtain the seal between the main body of the cap and the neck 5 of the container. Another seal is accomplished by a circular projection-shaped ring, referred to by 7; this ring-projection 7 gets in contrast with the plane upper part 51 of the neck of the container 5, as shown in FIG. 1. Together with the cylindrical wall 6, this ring-projection 7 contributes to the achievement of the seal between the cap and the neck of the container. It will be noticed later on that this particular double-seal structure ensures that there will be no outflow of liquid, which could have occurred because of the hole on the base surface of the main body.

Figure 4:
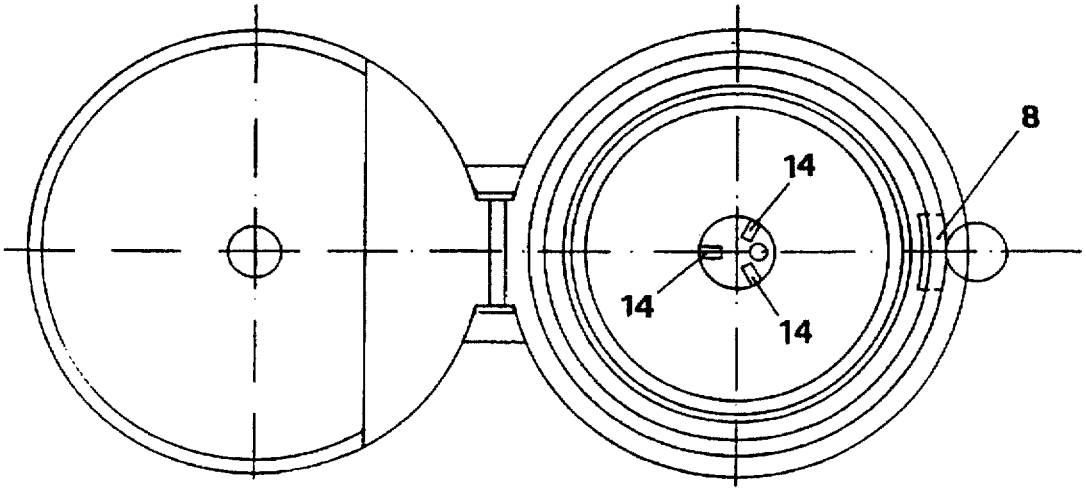
FIG. 4 shows a top view of the cap object of the invention.

As a matter of fact, as FIG. 4 shows more clearly, the base surface of the main body 2 has an opening 8 suitable for the passage of a mold part (not shown) through the main body 2 when the thermoplastic moulding of the hook 9 takes place. This hook 9 cooperates with the corresponding projection 10 of the wall of the cover 20 when the cover closes on the main body of the cap.

In the main body 2, in central position, there is also a generally cylindrical part 12 that projects upwards and has a hole 13 arranged in non-axial position, so that the liquid sprayed through said hole is directed forward with respect to the opening of the container.

Inside, the cylindrical part 12 has some fins 14 serving to fasten a suction pipe 15 that draws the liquid from the bottom of the container. The liquid is drawn out owing to the compression that is obtained by deforming the container itself. The cover, which is connected by means of a hinge 11 made of thermoplastic material, too, and is carried out by moulding together with the main body, has a hollow cylindrical element 21 in the middle, which will house the cylindrical part 12 of the main body when the cover closes on the main body itself.

Further, it can be noticed that the upper back wall 22 of the cover 20 is concave and its concave part faces outwards. More precisely, said wall 22 is part of a cylindrical surface of a cylinder, the horizontal axis of which is perpendicular to the cap axis. This device allows the cover 20 to deform stretching out forwards and to separate from the hook 9 when compression is exerted on the middle of the cover with the fingers of one hand opposite to each other, especially in the two knurled sections 23, only one of which is shown in FIG. 1.

Figure 3:
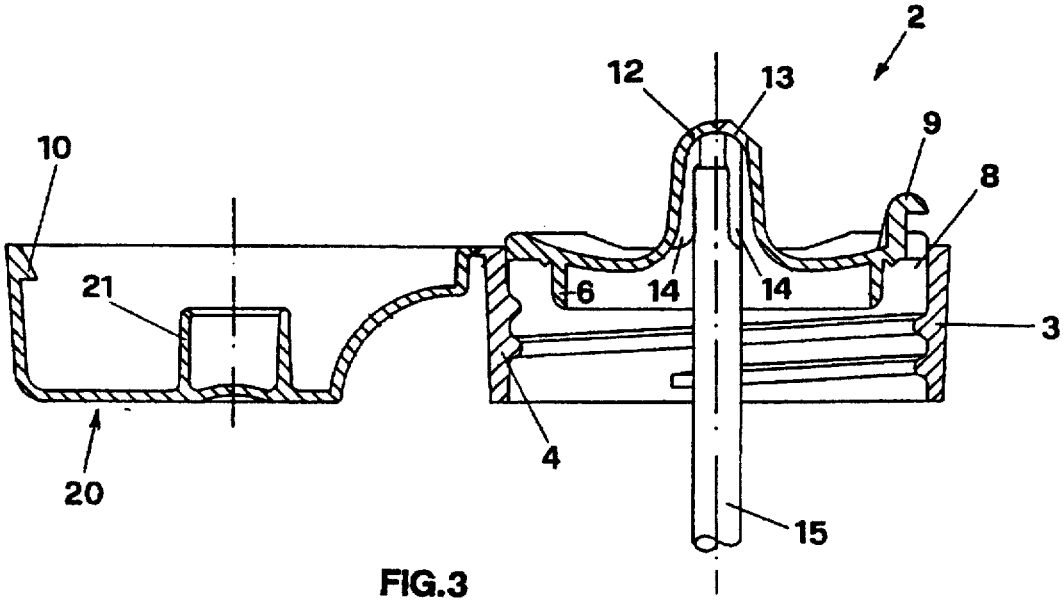
FIG. 3 shows a section of the cap object of the invention with open cover.

With reference to FIG. 3, it is clear that the cap object of the invention can be carried out by moulding it with thermoplastic material by means of a single mould provided with only one male part and one female part, since the hook 9 can be carried out with a projection of the male reaching the lower part of the horizontal wall of said hook, without making undercuts owing to the presence of the hole 8.

The simplification of the mould obviously results also in a reduction of the cost of the cap itself.

It has been observed that this simplification in itself does not absolutely compromise the sealing characteristics of said cap, since the second cylindrical wall 6 and the ring-projection 7, along with the thread 4, ensure the seal.

I claim:

1. A plastic cap for dispensing liquids adapted to be connected to the open neck of a deformable container having inner and outer wall portions and an upper edge for the passage of liquids through a suction pipe, comprising:

a main body; a cover, and a hinge connecting the main body to the cover formed as a single molded piece;

the main body being formed with a base surface and a peripherally located, depending cylindrical outer wall and a depending cylindrical inner wall for sealingly engaging the inner and outer wall portions of the open neck of the container respectively; the base surface including a generally centrally located, hollow cylindrical part projecting from the base surface, a distal end of said cylindrical part having an outlet opening for liquids and a first hook located near an outer edge of the base surface and projecting upwardly therefrom, said central part formed with inwardly projecting fins for engaging and securing the suction pipe therein for drawing liquid out of the container;

the cover formed with a depending hollow cylindrical element sealingly engaging the cylindrical part of the main body when the cover is closed for sealing the outlet opening and a second hook formed in an outer edge of the cover for cooperating with the first hook; and the main body being formed with a hole formed through the base between the inner and outer cylindrical parts under the first hook said hole located opposite the upper edge of the open neck and being sealed against liquid flow when the base is connected to the open neck of the container.

2. The cap according to claim 1 wherein the main body is formed with a depending ring projection between the outer wall and the inner wall, said projection sized for engaging the upper edge of the container opening to seal the cap against the edge.

3. The cap according to claim 1 wherein a rearward upper portion of the cover opposite the second hook is formed with an outwardly facing concave surface in the form of a cylindrical surface having an axis perpendicular to a central axis of the cap.

4. The cap according to claim 1 wherein the outer wall is sized for engaging an outer portion of the container opening.

5. The cap according to claim 1 wherein the inner wall is sized for sealingly engaging an inner portion of the container opening.

6. A cap according to claim 1 wherein the outlet opening for liquids is non-axial.

7. A plastic cap for dispensing liquids adapted to be connected to the open neck of a deformable container having inner and outer wall portions and an upper edge for the passage of liquids through a suction pipe, comprising:

a main body; a cover, and a hinge connecting the main body to the cover formed as a single molded piece;

the main body being formed with a base surface and a peripherally located, depending cylindrical outer wall and a depending cylindrical inner wall for sealingly engaging the inner and outer wall portions of the open neck of the container respectively; the base surface including a generally centrally located, hollow cylindrical part projecting from the base surface, a distal end of said cylindrical part having an outlet opening for liquids and a first hook located near an outer edge of the base surface and projecting upwardly therefrom, said central part formed with inwardly projecting fins for engaging and securing the suction pipe therein for drawing liquid out of the container;

the cover formed with a depending hollow cylindrical element sealingly engaging the cylindrical part of the main body when the cover is closed for sealing the outlet opening and a second hook formed in an outer edge of the cover for cooperating with the first hook;

a depending ring projection formed between the outer wall and the inner wall, said projection sized for matching the upper edge of the container opening; and the main body being formed with a hole formed through the base between the inner and outer cylindrical parts under the first hook and outboard of the ring projection, said hole located opposite the upper edge of the open neck and being sealed against liquid flow when the base is connected to the open neck of the container and the ring projector engages the upper edge thereof.

* * * * *